United States Patent [19]

Rivoal et al.

[11] 4,304,212

[45] Dec. 8, 1981

[54] OPTOELECTRONIC IGNITION DEVICE FOR AN INTERNAL COMBUSTION ENGINE

[75] Inventors: Yves Rivoal, Caen; Jean-Louis Vite, Bretteville sur Odon, both of France

[73] Assignee: U.S. Philips Corporation, New York, N.Y.

[21] Appl. No.: 963,545

[22] Filed: Nov. 24, 1978

Related U.S. Application Data

[63] Continuation of Ser. No. 783,941, Apr. 1, 1977, abandoned.

[30] Foreign Application Priority Data

Apr. 5, 1976 [FR] France ..... 76 09845

[51] Int. Cl.³ ..... F02P 3/04

[52] U.S. Cl. ..... 123/613; 123/647; 123/651; 250/205

[58] Field of Search ..... 123/148 E, 148 R, 146.5 A; 324/16 T, 391; 250/205, 231 SE

[56] References Cited

U.S. PATENT DOCUMENTS

| | | | |
|---|---|---|---|
| 2,774,033 | 12/1956 | Penn | 324/16 T |
| 3,297,009 | 1/1967 | Sasaki et al. | 123/148 E |
| 3,375,713 | 4/1968 | Gover | 324/16 T |
| 3,613,654 | 10/1971 | Gilbert | 123/148 E |
| 3,721,123 | 3/1973 | Heim | 250/205 |
| 3,791,364 | 2/1974 | Saita | 123/146.5 A |
| 3,839,659 | 10/1974 | Bruijning et al. | 123/148 E |
| 3,875,920 | 4/1975 | Williams | 123/146.5 A |
| 3,924,595 | 12/1975 | Brungsberg | 123/148 E |
| 3,931,804 | 1/1976 | Bowen | 123/148 E |
| 3,949,722 | 4/1976 | Linstedt et al. | 123/148 E |
| 4,030,469 | 6/1977 | Chateau | 123/148 E |
| 4,074,143 | 2/1978 | Rokos | 250/205 |
| 4,106,462 | 8/1978 | Hildebrandt et al. | 123/148 E |

*Primary Examiner*—Charles J. Myhre
*Assistant Examiner*—Andrew M. Dolinar
*Attorney, Agent, or Firm*—William J. Streeter; Bernard Franzblau

[57] ABSTRACT

An optoelectronic ignition device for an internal combustion engine requiring a single wire connection.

A light-emitting diode, a photo-detector 2 and a first resistor 9 are energized in series, and a second resistor 3 is connected in parallel with the photodetector 2. The spark producing means 10, 11, 12, 13 is controlled by the signal which is taken from the terminals of the resistor 9.

18 Claims, 2 Drawing Figures

OPTOELECTRONIC IGNITION DEVICE FOR AN INTERNAL COMBUSTION ENGINE

This is a continuation, of application Ser. No. 783,941, filed Apr. 1, 1977, abandoned.

The present invention relates to an optoelectronic spark ignition device for an internal combustion engine comprising, a light-emitting diode, a photo-detection element, a shutter mechanism which is driven by the engine and which periodically exposes the photo-detection element to the radiation from the diode, and means for producing a spark during each exposure period of said photo-detection element.

Ignition devices for internal combustion engines are known in which the mechanical contact breaker is replaced by an optical emission-detection assembly whose coupling is periodically interrupted by a mechanism which is driven by the engine. The emission device may be a light-emitting diode and the detector a photo-sensitive element such as a photo-diode or a phototransistor. In view of the dissipation of the diode and the ambient temperature conditions, attempts have been made to limit the time that the diode is driven to the minimum exposure time of the detector so as to limit the average power dissipated by the diode. A device which pursues this object is described in French Patent Specification No. 2,028,087. However, in devices of this type the light-emitting diode and the photo-sensitive element are supplied in parallel by the power source associated with the engine and the signal by which the spark is triggered is taken from a connection other than the supply connection and thus necessitates the use of a multipole connection between the assembly which replaces the contact breaker and the rest of the device constituted by the ignition coil, the signal amplifier and the other components which are needed. Owing to the cost of the device, its reliability, its compatibility with existing devices which utilize a mechanical contact breaker and which only require a single-pole connection using the chassis as a return path, a device by means of which a single-pole connection remains possible is to be preferred.

It is an object of the present invention to solve this problem and to provide an optoelectronic ignition device having a very high reliability, taking into account the ambient conditions to be anticipated for a device associated with a vehicle engine, such as temperature, vibrations and supply voltage. This object is achieved in accordance with the invention by using a limited number of simple elements while a single-pole connection is maintained between the assembly unit replacing the contact breaker and the rest of the device producing the sparks.

In accordance with the invention an optoelectronic ignition device for an internal combustion engine, which comprises a light source, e.g. a light-emitting diode, a photo-detection element, a shutter mechanism which is driven by the engine and which periodically exposes the said photo-detection element to the radiation from the diode, and means for producing a spark during each exposure period of said photo-detection element, is characterized in that:

said diode is supplied (energized) in series with a first resistor and with said photo-detection element, the last-mentioned element being constituted by at least one photo-transistor which is connected in parallel with a second resistor, said diode, said photo-detection element and said second resistor are assembled jointly into an assembly unit in combination with the shutter mechanism, said means for producing a spark are controlled by an amplifier which receives a voltage signal taken from the terminals of the first resistor.

The light-emitting diode and the photo-detection element are powered in series. The second resistor ensures that when the photo-detector is not driven, a diode current is obtained at which the light emission is weak. When the shutter is open this emission can drive the photo-transistor detector into conduction, which results in a current increase and an increased light emission. The effect is cumulative and the photo-transistor is saturated owing to the positive current feedback thus introduced, the maximum light intensity emitted by said diode being sufficient to ensure the saturation of the photo-transistor.

The signal which triggers the spark is taken from the terminals of a resistor which is connected in series with the power supply of the diode and of the photo-detector so that it is possible to connect the assembly unit of the device, which is combined with the shutter mechanism, to the car battery by means of a single wire, the return path being established via the chassis which is accessible both on this mechanism and at any other point where said spark producing means are installed.

The current which produces a weak emission in the diode, which just suffices to ensure that the photo-transistor will be turned on under conditions of minimum temperature and supply voltage, determines the total value of the first and the second resistor, which resistors are connected in series with the light-emitting diode when the photo-transistor does not allow any current to pass through.

The maximum permissible current in the diode under conditions of maximum temperature and supply voltage, allowance being made for the excitation cycle, determines the value of the first resistor. Thus, allowance is made for extreme conditions in respect of temperature and supply voltage.

Preferably the photo-detection element is constituted by a set of two transistors, one of which is a photo-transistor, connected in a Darlington arrangement whose high gain enables a signal of high amplitude to be obtained and which moreover has the advantage that it is relatively insensitive to substantial temperature variations, as may be anticipated in a device which is mounted on a thermal engine.

Advantageously, a second light-emitting diode which emits visible radiation is inserted in the supply circuit of the device. This diode is connected in the forward direction and it is placed at a location where it is visible. This diode thus serves as an ignition indicator and may be used for adjusting the ignition to the engine cycle as well as for checking the operation of the device.

The amplifier which receives the signal taken from the terminals of the first resistor, and the spark-producing means which it controls, may be of any known type. Preferably these means are constituted by an ignition coil of the generally used type whose primary is switched by a Darlington transistor circuit. Advantageously the connection between the first resistor (i.e. the resistor from whose terminals the switching signal is taken) and the Darlington circuit which performs this switching is established via a resistance/capacitance network. The capacitive connection thus introduced makes it possible both to eliminate slow variations of the voltage across the first resistor (from which the signal is taken) and to limit the off-time of the Darlington switching circuit to the time which is strictly necessary to obtain a spark of the correct duration, thus maximizing the time during which the ignition coil is allowed to recharge. This is not only an advantage at high speed, the time which is available for charging the ignition coil being inversely proportional to the speed of the shutter mechanism while the duty cycle of said mechanism is constant, but also at low speed, the time available for discharging the ignition coil then being longer than necessary.

The following description with reference to the accompanying drawings is given by way of example in order that the invention may be more fully understood.

Figure 1:
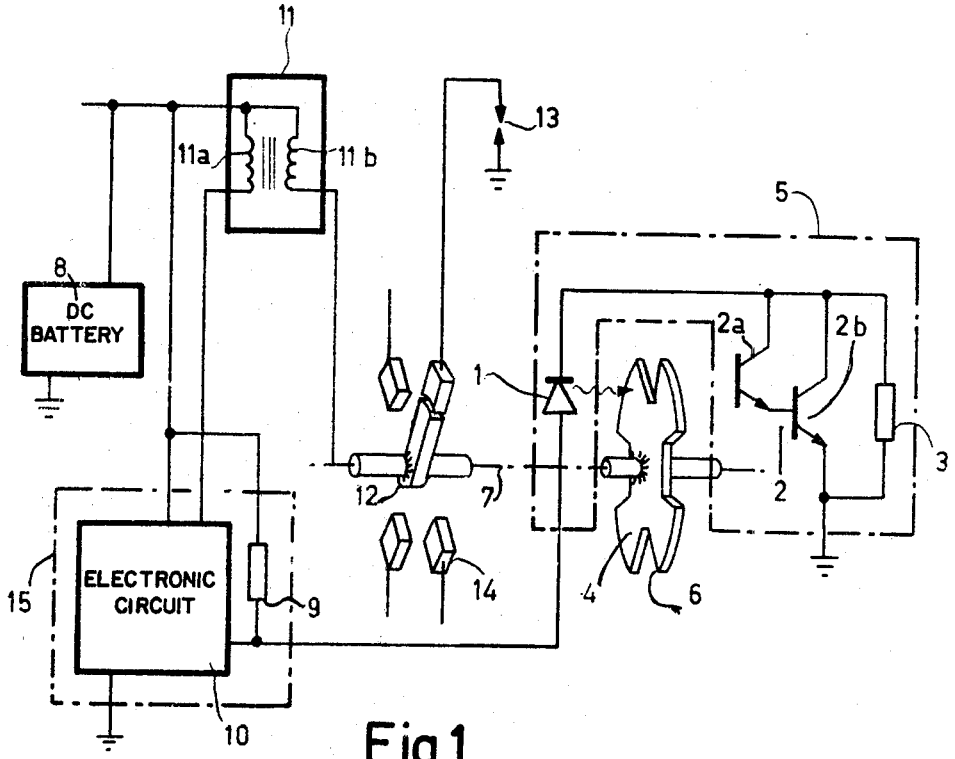
FIG. 1 is a circuit diagram of an embodiment of the device in accordance with the invention.

The device shown in FIG. 1 comprises an optoelectronic arrangement which is constituted by a light-emitting diode 1 and a Darlington circuit 2, which circuit is formed by a photo-transistor 2*a* and an amplifier transistor 2*b*. A resistor 3 is connected in parallel with the Darlington circuit 2. The diode 1, the Darlington circuit 2 and the resistor 3 are assembled jointly in a unit 5 so that they can cooperate optically. The unit 5, for example, takes the form of a bracket between whose arms a disc or a drum 4 rotates in which a certain number of windows 6 are formed (one window per cylinder for a motorcar engine) and which is mounted on a shaft 7 which is driven by the engine. The rotary disc 4 constitutes a shutter mechanism and is adapted to expose the photo-transistor of the Darlington circuit 2 to the radiation from the diode 1 upon each passage of a window 6 through the path of the emitted light beam.

The optoelectronic arrangement is powered by a battery 8, which constitutes the electric power source of the device, via a series resistor 9. The current returns via the chassis.

An electronic circuit 10 is connected across the resistor 9. The circuit 10 includes the means which can produce a spark each time that a window 6 allows the light beam to reach the photo-detector 2. The circuit 10 is adapted to cause the discharge of the primary 11*a* of an ignition coil 11 each time that the voltage across the resistor 9 reaches a predetermined value. The discharge of the primary of the ignition coil 11 results in a high-voltage pulse in its secondary 11*b*, which pulse, via one of the contacts, for example 14, of a distributor mechanism 12, is fed to a spark plug 13. In order to simplify the Figure the high voltage circuit is shown for one spark plug only.

The resistor 9 may be included in the circuit 10 in a monoblock module 15 which is placed at a suitable location. The connection between the module 15 and the optoelectronic arrangement 5 is realized by means of a single wire. The series connection of the diode 1 and the Darlington circuit 2 results in positive current feedback, the resistor 3 limiting this feedback by allowing a current to pass through the diode 1 for which this diode 1 emits a radiation which suffices to turn on the Darlington circuit 2 as soon as a window 6 allows the optical coupling between elements 1 and 2.

Figure 2:
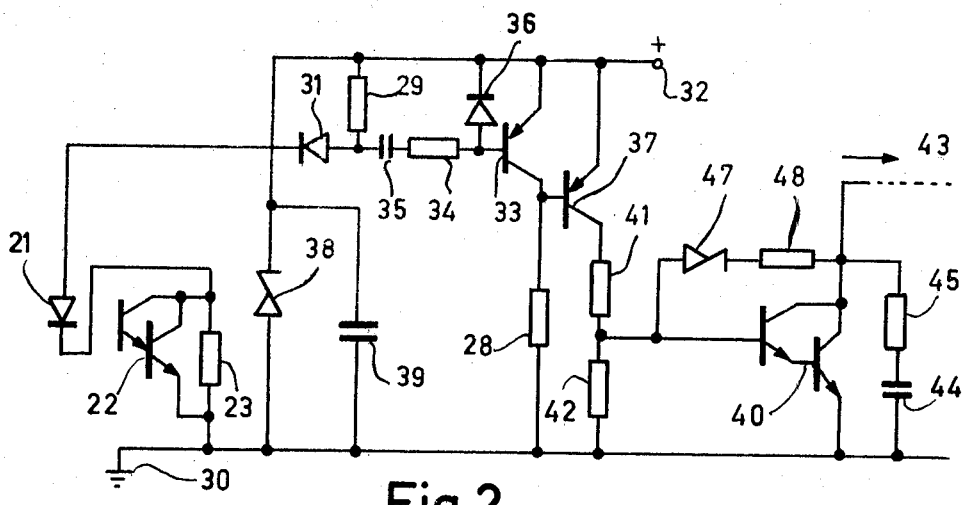
FIG. 2 is a circuit diagram of an example of the spark-producing means associated with a device in accordance with the invention.

FIG. 2 shows the circuit diagram of an example of the circuit 10 of FIG. 1.

In series with a light-emitting diode 21 and a Darlington circuit 22, a light-emitting diode 31 which emits light in the visible spectrum and a resistor 29 are included. A resistor 23 is connected in parallel with the Darlington circuit 22. The series circuit just described, which is formed by elements 29, 31, 21, 22 and 23 is included between the chassis 30 and the positive pole 32 of the electric power source (not shown). Elements 21, 22, 23 and 29 of FIG. 2 correspond to elements 1, 2, 3 and 9, respectively of FIG. 1.

The voltage across the resistor 29 is applied between the base and the emitter of a PNP transistor 33 via a resistor 34 and a capacitor 35 connected in series. A diode 36 is connected in parallel with the base-emitter junction of the transistor 33. The transistor 33, which drives a transistor 37, has a load resistor 28 which is included between the base of the transistor 37 and the chassis.

A Zener diode 38 and a capacitor 39 are connected in parallel between the supply terminals 30 and 32. A Darlington transistor arrangement 40 is driven by the transistor 37 via a resistor bridge 41, 42 which determines the drive voltage.

The primary of an ignition coil, not shown, is connected in series with the supply circuit of the Darlington arrangement 40 via the connection 43. A serially arranged capacitor 44 and a resistor 45 are connected in parallel with the supply circuit of the arrangement 40. A Zener diode 47 and a resistor 48 are connected in series between the base and collector of the Darlington arrangement 40.

The light-emitting diode 21 and the Darlington arrangement 22 are connected in series and the resulting positive feedback ensures that the diode 21 is only driven into full conduction during the time that this is strictly necessary. The resistor 23 limits the current feedback. The diode 31 serves as an ignition indicator and enables preadjustment of the ignition under optimum conditions. The resistor 29 is the resistor from which the voltage is taken which triggers the spark via the capacitor 35 and the resistor 34, which capacitive connection eliminates slow potential variations, for example variations owing to variations of the quiescent current of the circuit 22-21-31 as a function of temperature. The capacitive connection 34, 35 also enables the saturation period of the transistor 33 at low speeds to be limited to the time which is strictly necessary to obtain a spark of optimum duration. The saturation period of the transistor 33 at high speeds is only limited by the time of passage of the windows of the shutter mechanism, which time of passage itself is a function of the speed of rotation and the opening angle of the windows. The diode 36 enables the rapid drainage of electric charges when the Darlington arrangement 22 is turned off. The transistor 33 shapes the signal taken from the resistor 29 and moreover amplifies and inverts this signal. The transistor 37 amplifies this signal again. The Darlington arrangement 40 switches the magnetizing current in the primary of the ignition coil.

The Zener diode 38 and the capacitor 39 protect this circuit against transients, line interference and all kinds of excess voltages. The Zener diode 47 protects the Darlington arrangement 40 against excess voltages by turning off this arrangement as soon as an abnormal excess voltage occurs. The resistor 48 provides temperature stabilisation for the voltage which activates the diode 47. The network with the capacitor 44 and resistor 45 enables the voltage build-up and the discharge of the ignition coil to be controlled.

In an embodiment of the device in accordance with the invention, the light-emitting diode is a gallium-arsenide diode which emits light in the infrared spectrum and the Darlington photo-detection arrangement is of the silicon type. It is assumed that the supply voltage, which is generally 12 V, can vary from 6 V to 24 V, while the temperature near the motor on which the device is mounted can vary from −40° C. to +120° C.

The shutter disc has 4 windows for a 4-cylinder engine, which windows each consist of a cut-out with an opening angle of 18°, which represents a charging time for the ignition coil of 80% of the total time.

With a first resistor of approximately 500 ohms, from which the signal which triggers the spark is taken, and a second resistor of approximately 4000 ohms connected in parallel with the photo-detection Darlington arrangement, the current in the light-emitting diode when the photo-detection Darlington arrangement is not exposed is of the order of 1 mA and when the photo-detection Darlington arrangement is excited it is greater than 20 mA.

The capacitive connection between the first resistor and the signal amplifier is constituted by a 1 μF capacitor and a 150-Ohm resistor so that at engine speeds lower than 3000 revolutions per minute the available duration for the discharge of the ignition coil is limited to 1.6 msec owing to this capacitive connection. Above 3000 rpm this duration is only limited by the time of passage of each shutter window. In both cases the duration of the spark which is produced remains within limits which are near an optimum duration.

What is claimed is:

1. A two-wire optoelectronic spark ignition device for an internal combustion engine comprising, a light source, a photo-detection element, a shutter mechanism adapted to be driven by the engine and arranged to periodically expose the photo-detection element to light radiation from said light source, means for producing a spark during each exposure period of the photo-detection element, an amplifier for controlling the operation of the spark producing means, a first resistor coupled to the amplifier to supply a voltage signal thereto for controlling said operation of the spark producing means, a second resistor connected in parallel with the photo-detection element, said light source, said photo-detection element and said second resistor being combined into an assembly unit, a first connection wire from said assembly unit for connecting said light source and said photo-detection element in a series circuit through said first resistor to a first terminal of a source of supply voltage, a second connection wire from the assembly unit for connecting the assembly unit to a second terminal of the supply voltage source thereby to connect said assembly unit to the supply voltage source and to said amplifier by means of only said first and second connection wires.

2. An ignition device as claimed in claim 1 further comprising a series type resistor-capacitor network coupling the first resistor signal voltage to the amplifier and having a time constant chosen so as to eliminate slow variations of the signal voltage.

3. An ignition device as claimed in claim 1 wherein the photo-detection element comprises a photo-transistor and an amplifier transistor connected together to form a Darlington circuit and the light source comprises a light emitting diode.

4. An ignition device as claimed in claim 1 wherein said first and second connection wires provide a series circuit across the terminals of the supply voltage source comprising said first and second resistors and said light source.

5. A spark ignition device for an internal combustion engine comprising, a first resistor, an assembly unit comprising a radiation source connected in series with a radiation-detection element to first and second terminals of the assembly unit and a second resistor connected in parallel with the radiation-detection element, a shutter mechanism adapted to be driven by the engine and arranged to periodically expose the radiation-detection element to radiation from said radiation source, means for producing a spark in synchronism with the periodic exposure of the radiation-detection element, means coupling said first resistor to an input of the spark producing means to supply a signal to control the operation of the spark producing means in response to the periodic exposure of the radiation-detection element, a first conductor for connecting said first terminal of the assembly unit to a first terminal of a source of supply voltage, and a second conductor for connecting the second terminal of the assembly unit to a second terminal of the supply voltage source via said first resistor whereby said first resistor and said assembly unit are connected in series across the terminals of the supply voltage source and the assembly unit is connected to the input of the spark producing means and to the two terminals of the supply voltage source by means of only said first and second conductors.

6. An ignition device as claimed in claim 5 wherein said spark producing means includes an amplifier having an input coupled to receive the signal developed across the first resistor and an output for controlling the production of sparks by the spark producing means.

7. An ignition device as claimed in claim 5 wherein the radiation source comprises a light emitting diode and the radiation-detection element comprises a photo-transistor and wherein the series connection of the diode and the photo-transistor causes the intensity of the light emitted by the diode to be dependent on the amount of light received therefrom by the photo-transistor.

8. An ignition device as claimed in claim 7 further comprising an amplifier transistor coupled to the photo-transistor to form a Darlington circuit that switches between a saturated state and a cut-off state in response to the periodic exposure of the photo-transistor to the light from the diode.

9. An optoelectronic spark ignition device for an internal combustion engine operative in an automotive vehicle chassis comprising, a first light-emitting diode, a photo-detection element including at least one photo-transistor, a shutter mechanism driven by the engine and arranged to periodically expose the photo-detection element to the light radiation from the diode, means for producing a spark during each exposure period of said photo-detection element, first and second resistors, first means for connecting the first diode in series circuit with the first resistor and with said photo-detection element to the terminals of a source of supply voltage that has one terminal connected to the chassis, second means for connecting said one photo-transistor in parallel with the second resistor, said diode, said photo-detection element and said second resistor comprising an assembly unit for operation with the shutter mechanism, said first connecting means connecting said assembly unit to the chassis and via only a single connection wire to the first resistor and the spark producing means, and an amplifier which receives a voltage signal from the terminals of the first resistor and connected in circuit so as to control the operation of the spark producing means.

10. An ignition device as claimed in claim 9, wherein the photo-detection element comprises a set of two transistors connected in a Darlington arrangement and one of which comprises said photo-transistor.

11. An ignition device as claimed in claim 10 wherein the spark producing means comprise a coil whose discharge is controlled by a second Darlington transistor arrangement, said spark producing means comprising at least a transistor which amplifies and inverts the signal taken from the terminals of the first resistor in such a way that a spark is produced during the saturated state of the photo-detection Darlington arrangement.

12. An ignition device as claimed in claim 9 further comprising a second light-emitting diode which emits visible light and is connected in the circuit comprising the first resistor, the first diode and the photo-detection element, the second diode being connected between the two last-mentioned elements and the first resistor.

13. An ignition device as claimed in claim 9 wherein the second resistor, the photo-detection element and the first light-emitting diode are jointly assembled so as to obtain an optical coupling in a monolithic two legged yoke between whose limbs a circular disc rotates and in which disc windows are formed, the first resistor being incorporated in a module which also includes a spark triggering control circuit of the spark producing means.

14. An optoelectronic spark ignition device for an internal combustion engine comprising, a first light-emitting diode, a photo-detection element including at least one photo-transistor, a shutter mechanism driven by the engine and arranged to periodically expose the photo-detection element to the light radiation from the diode, means for producing a spark during each exposure period of said photo-detection element, first and second resistors, first means for connecting the first diode in series circuit with the first resistor and with said photo-detection element to the terminals of a source of supply voltage, second means for connecting said one photo-transistor in parallel with the second resistor, said diode, said photo-detection element and said second resistor comprising an assembly unit for operation with the shutter mechanism, and an amplifier which receives a voltage signal from the terminals of the first resistor and connected in circuit so as to control the operation of the spark producing means, and wherein the first resistor is connected to the amplifier via a resistor-capacitor network having a time constant which limits the time duration available for the production of a spark only below a predetermined speed of the shutter mechanism.

15. An optoelectronic spark ignition device for an internal combustion engine comprising, a first light-emitting diode, a photo-detection element including at least one photo-transistor, a shutter mechanism driven by the engine and arranged to periodically expose the photo-detection element to the light radiation from the diode, means for producing a spark during each exposure period of said photo-detection element, first and second resistors, first means for connecting the first diode in series circuit with the first resistor and with said photo-detection element to the terminals of a source of supply voltage, second means for connecting said one photo-transistor in parallel with the second resistor, said diode, said photo-detection element and said second resistor comprising an assembly unit for operation with the shutter mechanism, and wherein said first connecting means comprises only two external conductors which connect the assembly unit to the supply voltage source and the spark producing means, and an amplifier which receives a voltage signal from the terminals of the first resistor and connected in circuit so as to control the operation of the spark producing means.

16. An ignition device as claimed in claim 15 further comprising a series type resistor-capacitor network coupling the first resistor signal voltage to the amplifier and having a time constant so as to eliminate slow variations of the signal voltage.

17. An ignition device as claimed in claim 15 wherein said first and second connecting means provide a current path comprising said first and second resistors and said first diode connected together to form a series circuit across the terminals of the supply voltage source.

18. An optoelectronic spark ignition device for an internal combustion engine adapted for operation in an automobile chassis comprising, a first light-emitting diode, a photo-detection element including at least one photo-transistor, a shutter mechanism driven by the engine and arranged to periodically expose the photo-detection element to the light radiation from the diode, means for producing a spark during each exposure period of said photo-detection element, first and second resistors, first means for connecting the first diode in series circuit with the first resistor and with said photo-detection element to the terminals of a source of supply voltage that has one terminal connected to said automobile chassis, second means for connecting said one photo-transistor in parallel with the second resistor, said diode, said photo-detector element and said second resistor comprising an assembly unit for operation with the shutter mechanism, and said first connecting means includes a first conductor connecting one terminal of the assembly unit to the automobile chassis and a second conductor connecting a second terminal of the assembly unit to the first resistor and to a second terminal of the supply voltage source, said first and second conductors being the sole means for connecting said assembly unit to the first resistor and to the supply voltage source, and an amplifier which receives a voltage signal from the terminals of the first resistor and connected in circuit so as to control the operation of the spark producing means.

* * * * *